US006557729B2

(12) United States Patent
Gauthier

(10) Patent No.: US 6,557,729 B2
(45) Date of Patent: May 6, 2003

(54) SOAP DISPENSING SYSTEM WITH SINGLE SOAP PUMP AND TWO UNPRESSURIZED SOAP CONTAINERS

(75) Inventor: Jerome M. Gauthier, Roselle, IL (US)

(73) Assignee: Sloan Valve Company, Franklin Park, IL (US)

( * ) Notice: Subject to any disclaimer, the term of this patent is extended or adjusted under 35 U.S.C. 154(b) by 0 days.

(21) Appl. No.: 09/788,093

(22) Filed: Feb. 20, 2001

(65) Prior Publication Data

US 2002/0113083 A1 Aug. 22, 2002

(51) Int. Cl.[7] ..... B67D 5/08

(52) U.S. Cl. ..... 222/63; 222/66; 222/136; 222/144.5; 417/36; 417/38; 417/477.1

(58) Field of Search ..... 222/63, 65, 66, 222/136, 144.5; 137/113; 417/36, 38, 422, 477.1

(56) References Cited

U.S. PATENT DOCUMENTS

| | | | | |
|---|---|---|---|---|
| 3,531,021 A | | 9/1970 | Bassett | |
| 4,014,461 A | * | 3/1977 | Harvill | 222/136 |
| 4,247,018 A | * | 1/1981 | Credle | 137/113 |
| 4,275,823 A | * | 6/1981 | Credle, Jr. | 137/113 |
| 4,335,835 A | | 6/1982 | Beigler et al. | |
| 4,493,435 A | * | 1/1985 | Hartley | 137/113 |
| 4,895,276 A | | 1/1990 | Maldonado | |
| 5,042,691 A | | 8/1991 | Maldonado | |
| 5,088,625 A | | 2/1992 | Farber et al. | |
| 5,199,604 A | * | 4/1993 | Palmer et al. | 222/136 |
| 5,242,081 A | | 9/1993 | van der He den et al. | |
| 5,464,388 A | * | 11/1995 | Merte et al. | 222/144.5 |
| 5,465,874 A | * | 11/1995 | Roach et al. | 222/136 |
| 5,944,227 A | | 8/1999 | Schroeder et al. | |
| 6,062,427 A | * | 5/2000 | Du | 137/113 |

* cited by examiner

*Primary Examiner*—Kenneth Bomberg
(74) *Attorney, Agent, or Firm*—Cook, Alex, McFarron, Manzo, Cummings & Mehler, Ltd.

(57) ABSTRACT

A soap dispensing system includes non-pressurized first and second soap containers connected to a soap manifold. The manifold has a first inlet connection to the first soap container and a second inlet connection to the second soap container. There is a soap outlet on the manifold. A soap conduit extends from a first dispensing opening on the manifold to a second dispensing opening on the manifold. A two direction peristaltic pump is associated with the soap conduit to move soap either from the first dispensing opening to the second dispensing opening or in the opposite direction. There are valves within the soap manifold for connecting the first inlet, first dispensing opening, second dispensing opening, second inlet opening, and the outlet to provide soap, upon operation of the pump, from one of said containers, through said soap conduit, to the manifold outlet.

10 Claims, 1 Drawing Sheet

SOAP DISPENSING SYSTEM WITH SINGLE SOAP PUMP AND TWO UNPRESSURIZED SOAP CONTAINERS

THE FIELD OF THE INVENTION

The present invention relates to soap dispensers and more specifically to the use of two unpressurized soap containers and a single peristaltic soap pump. Two soap containers are connected to a single pump and the rotational direction of the pump determines which soap container supplies soap. A soap manifold, and a soap conduit which extends around the pump, forms a replaceable unit which may be connected between the soap containers and the pump. The soap system is never empty in that when one container becomes empty, a sensor indicates that fact to a control board which signifies to maintenance personnel to replace the empty soap container, with the system continuing to function with the filled soap container. The system is completely disposable as the soap conduit, and the soap manifold may be easily changed at predetermined intervals.

The soap manifold is connected to both soap containers, to the ends of the soap conduit which extends about the peristaltic pump and to a soap outlet. Valves within the manifold control the path of flow from either one or the other of the two soap containers to the soap outlet.

SUMMARY OF THE INVENTION

The present invention relates to a soap dispensing systems and more specifically to a soap dispensing system utilizing two independent soap containers and a single soap pump.

A primary purpose of the invention is to provide a soap dispensing system which has automatic soap path selection between two unpressurized soap containers and a single soap pump.

Another purpose is to provide a manifold for use in a soap dispenser, which manifold is effective to provide soap container selection on the basis of the direction of rotation of a peristaltic pump.

Another purpose of the invention is to provide a soap dispensing system which includes sensors, and a control board connected to the sensors, with the sensors determining the condition of the soap containers and thus the soap container which will be used upon operation of the soap pump.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
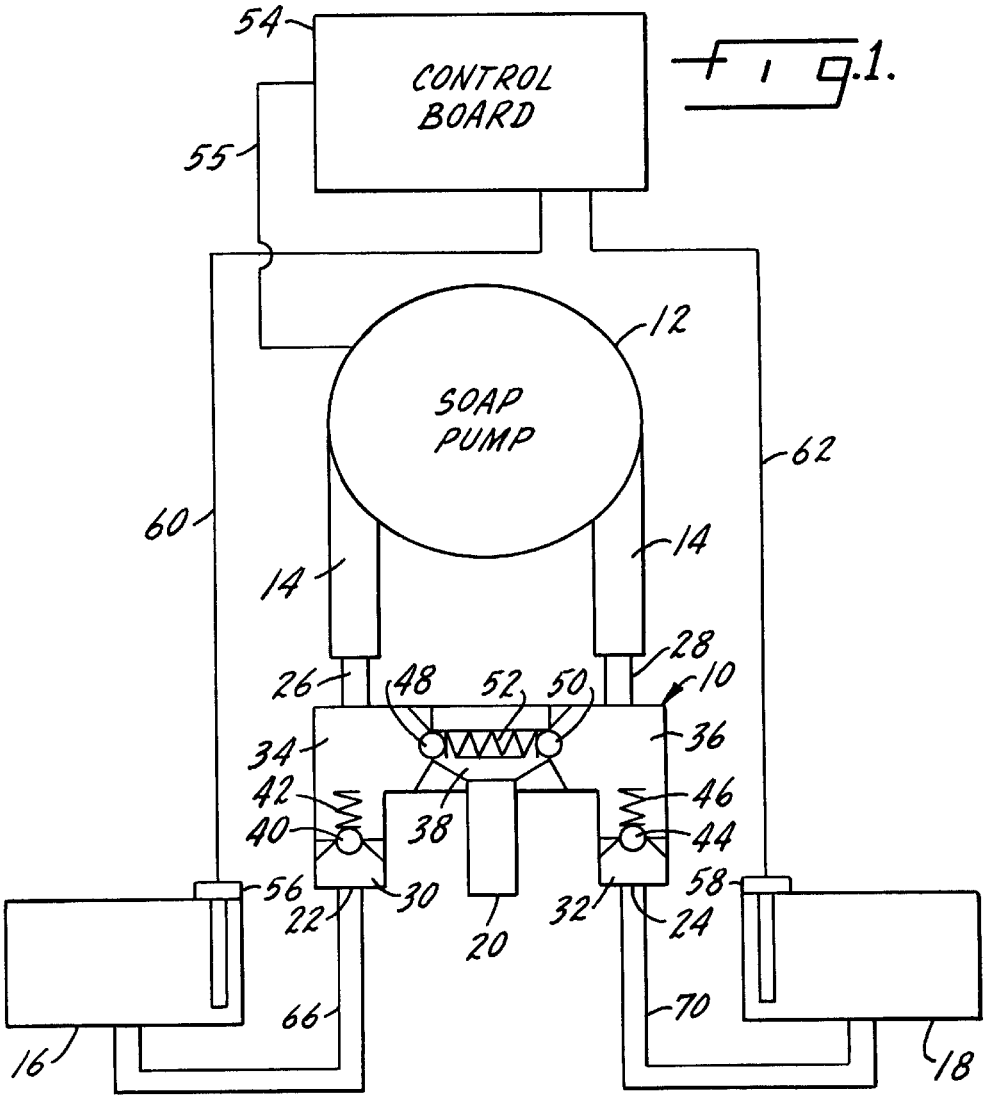
FIG. 1 is a diagrammatic illustration of one embodiment of a two container soap dispensing system.

In the drawing a soap manifold is indicated at 10, a peristaltic soap pump is indicated at 12, and there is a flexible tube 14 which extends about the peristaltic pump and connects to the soap manifold. There is a first soap container indicated at 16, a second soap container indicated at 18, and the manifold 10 has a soap outlet 20 which will be connected to a suitable point of use. The soap container in the FIG. 1 embodiment is rigid with a vent to atmosphere. It cannot hold a vacuum and will be used in a non-sterilized soap path. In the FIG. 2 embodiment the soap containers are collapsible, sealed and have no vent to atmosphere. The soap container can hold a vacuum and would be used in a closed sterilized soap path.

The manifold 10 includes an inlet 22 connected to soap container 16 and an inlet 24 connected to soap container 18. There is a first dispensing opening 26 which connects one end of the conduit 14 to the soap manifold 10 and there is a second dispensing opening 28 which connects the other end of the conduit 14 to the manifold 10.

The manifold 10 and the conduit 14 which is connected to the two dispensing openings 26 and 28 may be in the form of a replaceable cartridge. Thus the pump, which does not ever contain soap within its mechanism, could stay in place and the carrying parts of the soap dispensing system could be replaced by a new cartridge. The two soap containers 16 and 18 may be included in the cartridge or they may not. They may be replaceable independently of the manifold.

The manifold 10 includes a plurality of soap chambers. There is a first soap chamber 30 which is connected to the first soap container 16 through the first inlet 22. There is a second soap chamber 32 which is connected to the second soap container 18 through the inlet 24. There is a third soap chamber 34 which is in direct communication with the dispensing opening 26 and there is a fourth soap chamber 36 which is in communication with the second soap dispensing opening 28. There is a fifth soap chamber 38 which is in communication with the soap outlet 20. It should be understood that preferably the soap containers are non-pressurized and the action of the pump, through the manifold as described hereinafter, will move soap from either of the non-pressurized containers to the soap outlet.

There is a first check valve 40 positioned within the manifold 10, spring biased to a closed position by a spring 42, which controls the passage of soap from the first soap container 16, through soap chamber 30, to the third soap chamber 34. Similarly, there is a second check valve 44, spring biased to a closing position by a spring 46, which controls the flow of soap from the second soap container 18 through the second soap chamber 32, to the fourth soap chamber 36.

There are further check valves 48 and 50, spring biased in opposite directions by a spring 52 which valves control the flow of soap from the third soap chamber 34 or the fourth soap chamber 36 to the fifth soap chamber 38.

Figure 2:
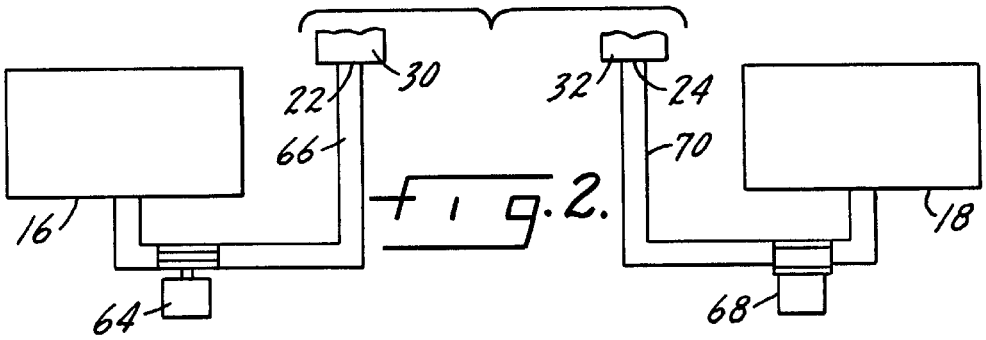
FIG. 2 is a diagrammatic illustration of a second embodiment.

It is desirable in a soap dispensing system utilizing more than one soap container, and in which the system will switch from an empty container to a full container, to have a means of sensing the condition of each of the soap containers. For that purpose there is an electrical control board 54 which provides electric power through a line 60 to the soap pump 12. There are alternate ways of sensing the condition-empty or full-of the soap containers and one such way is to provide a soap pressure sensor 56, physically associated with the first soap container 16, and a similar sensor 58 physically associated with the second soap container 18. Both of these sensors are connected by lines 60 and 62, respectively, to the control board. In FIG. 1, the soap containers are refillable bottles and the sensors 56, 58 directly reflect the amount of soap within each container. For example, the sensor may use an air bladder which is compressed by soap in the container. Any suitable form of pressure sensor switch may be utilized and it may be a switch which senses either when the soap container is full or the soap container is empty. Either type of information forwarded to the control board will allow the control board microprocessor to provide the appropriate control signals to move the pump 12 in one of its two directions.

An alternative to the use of a pressure sensor switch directly associated with each of the soap containers is to place a pressure sensor switch 64 in the line 66 connecting the first soap container 16, and the manifold 10 and to place a similar pressure sensor switch 68 in the line 70 between the second soap container 18 and the manifold 10. In the FIG. 2 embodiment, the soap containers are collapsible bags which are not re-used. When the bag collapses, this creates a vacuum in lines 66,70, which condition is noted by the sensors 64, 68.

Either form of switch and container combination is satisfactory as what is important is to provide a means for sensing the empty or full condition of a soap container and this can be done either at the container itself or in the conduit leading from the container to the soap manifold.

In operation, and assuming the peristaltic pump is to draw soap from container 16, the pump will rotate in a clockwise direction. As the pump so rotates, there will be a pressure drop in soap chamber 34, which drop will be greater then the force of spring 42 holding check valve 40 in a closed position. Thus, check valve 40 will open and soap will be sucked from chamber 30 and moved by the pump from that chamber to chamber 34, and then through the conduit 14 to chamber 36. As the pressure in chamber 36 increases, it will overcome the force of spring 52 holding check valve 50 in a closed position, allowing soap from chamber 36 to flow into chamber 38 through the outlet 20 and to a point of use. Thus, the direction of rotation of the peristaltic pump 12 will determine which soap container provides soap to be directed to the point of use.

The operation just described utilized the first container 16 as the non-pressurized source of soap. If the pump rotates in a counterclockwise direction, then soap container 18 will be the source of soap and the operation of the check valves will be the opposite of that described.

The sensors indicate to the control board the condition of the soap containers. Normal operation will focus on one container until it is empty and then the control board will cause rotation of the pump in the opposite direction and the other container will be utilized as the source of soap. The control board will also have suitable indicia or indicators to allow maintenance personnel to know when a container is empty and must be replaced. Either a single container may be replaced or refilled, or both containers may be used up and then the manifold, conduit, and soap containers may be replaced.

What is important in the invention is that there are alternative soap containers for use and that soap never enters the pump itself. The invention provides a means to quickly and easily replace the soap paths and all parts that come in contact with the soap through the use of a manifold which may be connected to the soap containers and the conduit that extends about the peristaltic pump. The direction of rotation of the pump determines which soap container is supplying soap and the control board provides the necessary direction to the soap pump by accepting information from the soap container sensors as to the conditions of the containers.

Whereas the preferred form of the invention has been shown and described herein, it should be realized that there may be many modifications, substitutions and alterations thereto.

The embodiments of the invention in which an exclusive property or privilege is claimed are defined as follows:

1. A soap dispensing system including a first non-pressurized soap container and a second non-pressurized soap container, a soap manifold having a first inlet connection to said first soap container and a second inlet connection to said second soap container, a soap outlet from said soap manifold, a soap conduit extending from a first dispensing opening on said manifold to a second dispensing opening on said manifold, a two direction soap pump associated with said soap conduit to move soap either from said first dispensing opening to said second dispensing opening or from said second dispensing open to said first dispensing opening, valve means within said soap manifold for connecting said first inlet, first dispensing opening, second dispensing opening, second inlet opening, and said outlet to provide soap, upon operation of said pump, from one of said containers, through said soap conduit, to said manifold outlet.

2. The soap dispensing system of claim 1 wherein said two direction pump is a peristaltic pump, with said soap conduit extending about said peristaltic pump.

3. The soap dispensing system of claim 1 wherein said manifold valve means includes valve elements, movable between open and closed positions, and associated with said first inlet, said second inlet, and said outlet.

4. The soap dispensing system of claim 3 wherein said manifold includes first, second, third, fourth, and fifth soap chambers, with said first chamber being connected to said first inlet, said second chamber being connected to said second inlet, said third chamber being connected to said first dispensing opening, said fourth chamber being connected to said second dispensing opening, and said fifth chamber being connected to said outlet, said valve elements controlling communication between said chambers.

5. The soap dispensing system of claim 4 wherein each of said valve elements is spring biased to a normally closed position.

6. The soap dispensing system of claim 5 wherein there is a first normally closed valve element controlling communication between said first soap chamber and said third soap chamber, a second normally closed valve element controlling communication between said second soap chamber and said fourth soap chamber, and a pair of normally closed valve elements controlling communication between said third and fourth soap chambers and said fifth soap chamber.

7. The soap dispensing system of claim 6 wherein rotation of said pump in a first direction creates a pressure drop in said third soap chamber, opening said first valve element, to draw soap from said first container, into said first soap chamber and into said third soap chamber, passage of soap through said conduit, from said first dispensing opening, to said second dispensing opening, filling said fourth soap chamber, to open the valve element associated therewith to cause soap to flow from said fourth soap chamber, to said fifth soap chamber and to said soap outlet.

8. The soap dispensing system of claim 1 further including a control board and electric power connected thereto, an electrical connection from said control board to said pump, a first sensor associated with said first soap container, a second sensor associated with said second soap container, each of said sensors being connected to said control board and functioning to indicate a soap container empty/full condition.

9. The soap dispensing system of claim 8 wherein each of said sensors is located directly at a soap container.

10. The soap dispensing system of claim 8 wherein each of said sensors is located in a soap path between a soap container and said soap manifold.

* * * * *